United States Patent [19]

Dermarkar

[11] Patent Number: 4,731,133

[45] Date of Patent: Mar. 15, 1988

[54] AMORPHOUS AL-BASED ALLOYS ESSENTIALLY CONTAINING NI AND/OR FE AND SI AND PROCESS FOR THE PRODUCTION THEREOF

[75] Inventor: Salim Dermarkar, Paris, France

[73] Assignee: Cegedur Pechiney, Paris, France

[21] Appl. No.: 829,061

[22] Filed: Feb. 13, 1986

[30] Foreign Application Priority Data

Feb. 27, 1985 [FR] France ..... 85 03318

[51] Int. Cl.[4] ..... C22C 21/02

[52] U.S. Cl. ..... 148/437; 148/13; 148/403; 419/66; 419/67; 420/548

[58] Field of Search ..... 148/403, 13, 437; 420/548; 419/66, 67

[56] References Cited

U.S. PATENT DOCUMENTS 4,595,429 6/1986 Le Caer et al. ..... 148/403

*Primary Examiner*—R. Dean

*Attorney, Agent, or Firm*—Dennison, Meserole, Pollack & Scheiner

[57] ABSTRACT

The invention is directed to microcrystalline Al-based alloys produced by annealing an alloy formed initially in a substantially amorphous state by rapid solidification (about $10^4$ K/sec) and having a composition consisting essentially of, in atomic %:

from 5 to 30% Si from 11 to 22% Ni wherein the Ni may be partially substituted by Fe up to 10%, by V or B up to 5 atomic % each, or totally substituted by Mn up to 22 atomic %, and wherein Fe+Ni+Si≦42%. In the microcrystalline state, in the vicinity of the first crystallization peak, there is a metastable hexagonal phase whose crystalline parameters are about a=0.661 nm and c=0.378 nm.

11 Claims, 7 Drawing Figures

Figure 1:
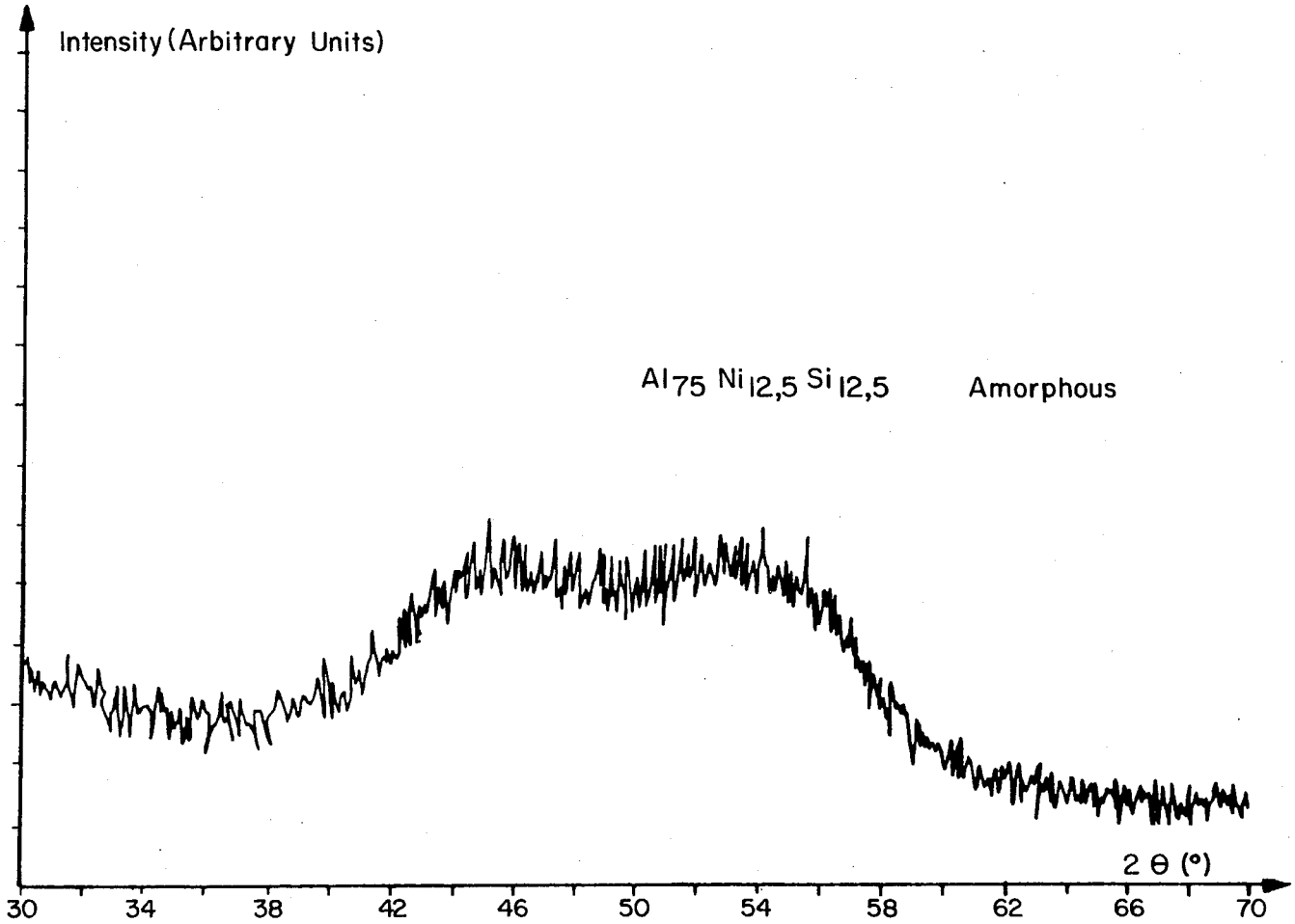

AMORPHOUS AL-BASED ALLOYS ESSENTIALLY CONTAINING NI AND/OR FE AND SI AND PROCESS FOR THE PRODUCTION THEREOF

The invention relates to Al-based alloys essentially containing Ni and/or Fe and Si as main alloy elements, which are produced in an essentially amorphous state, by relatively rapid solidification. The term essentially amorphous is used to denote an alloy in which the crystallised fraction by volume is at most equal to 25%.

Although amorphous Al-based alloys are already known generally (see French patent application No. 2 529 209), the production thereof at practical and industrial levels falls foul of major difficulties by virtue of the extremely strict production parameters that have to be complied with, in order to produce the essentially amorphous structure.

Such parameters are primarily the temperature range for 'quenching' from the liquid state and the minimum solidification rate.

Industrial development of such alloys is therefore governed by the selection of alloys having a sufficiently wide quenching range (about 100° C. between the temperature of the liquid alloy and the liquidus thereof) and rates of solidification which are not excessively rapid (of the order of $10^4$ K/sec).

Only a small number of alloys according to the invention fulfil those aims. Such alloys contain (in atomic %):

from 5 to 30% of Si from 11 to 22% of Ni $Fe+Ni+Si \leqq 42\%$ wherein the (Ni) may be partially substituted by Fe (up to 10%) by V or B (up to 5 atomic %) or totally substituted by Mn (up to 22 atomic %), the balance being formed by Al and the usual production impurities.

The alloys preferably contain:

from 9 to 25% of Si from 11 to 19% of Ni with $21 \leqq Fe+Ni+Si \leqq 38\%$ the manganese being limited to 5 atomic %.

Under those conditions, it is possible reproducibly to obtain amorphous industrial alloys.

Those alloys have an array of remarkable properties in the amorphous or essentially amorphous state as well as in the microcrystallised state which is obtained by annealing of the amorphous or essentially amorphous state. Those properties result from the introduction of a substantial amount of alloying elements without detrimental effects in respect of segregation or the formation of fragile intermetallic phases of dimensions greater than 10 μm. The unique combination of the compositions and structures, which is achieved in that way, provides such alloys with high levels of hardness, excellent hot stability for long-term annealing operations and particular tribological properties.

The possibility of obtaining essentially amorphous structures with rates of solification of the order of $10^4$ K/sec makes it possible to use different processes for producing such alloys. Thus, besides processes involving rapid quenching on a wheel or gaseous atomisation, it is possible to use plasma deposit of pre-alloyed powders on a metal substrate (or a good conductor of heat such as graphite) or chemical or electrochemical surface nickel plating of an Al alloy containing Si (type AS), with preferably from 10 to 25% of Si, followed by fusion of the deposit of nickel and a portion of the substrate by means of a concentrated and localised heat source such as a laser, plasma torch, HF heating, TIG torch, etc.

One consolidation process consists of crushing of strips produced by casting on a wheel, sifting at below 100 μm, hot compression at between 350° and 400° C. and hot extrusion at about 400° to 450° C. In that way it is possible to produce solid products.

Figure 2:
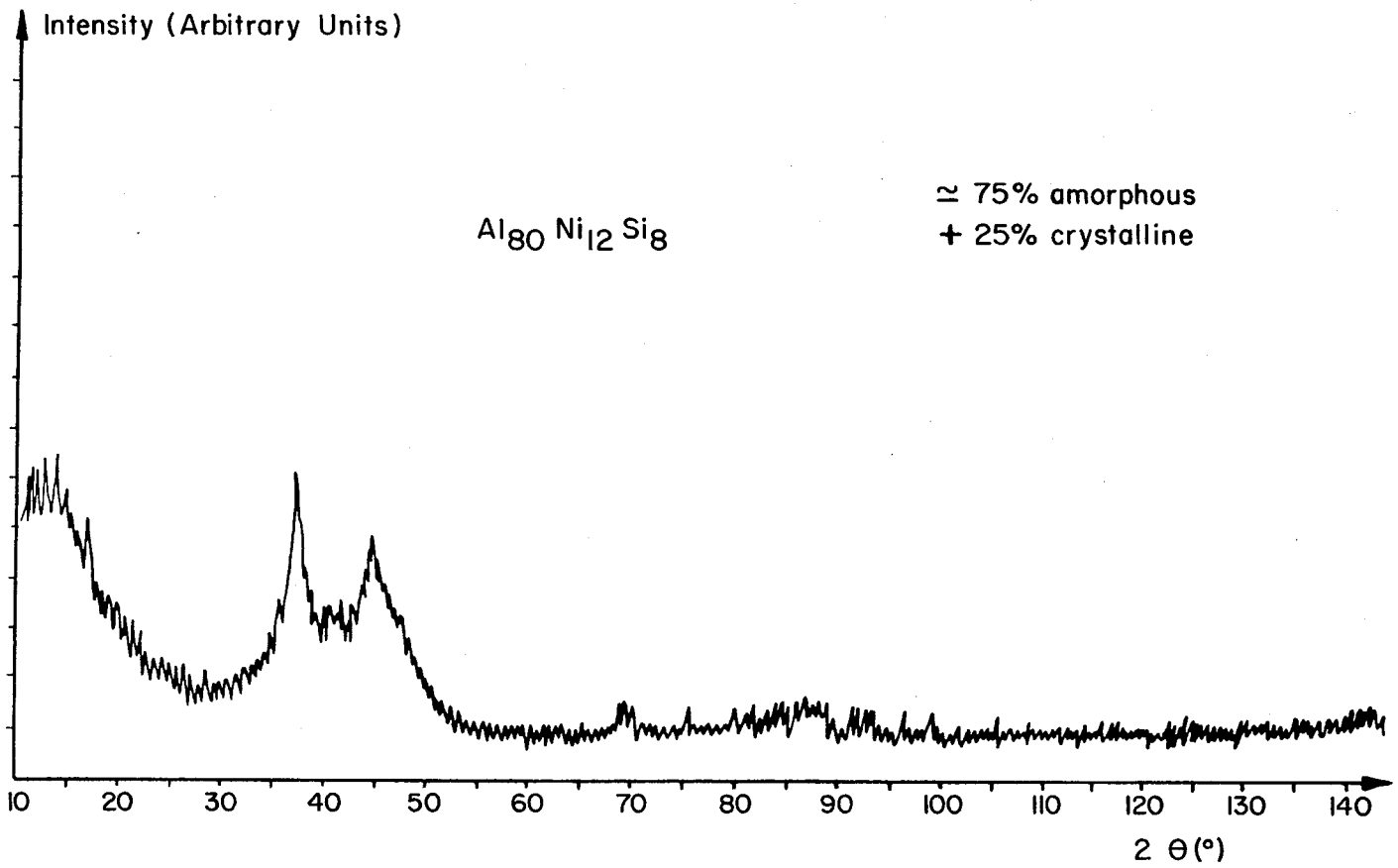
Figure 3:
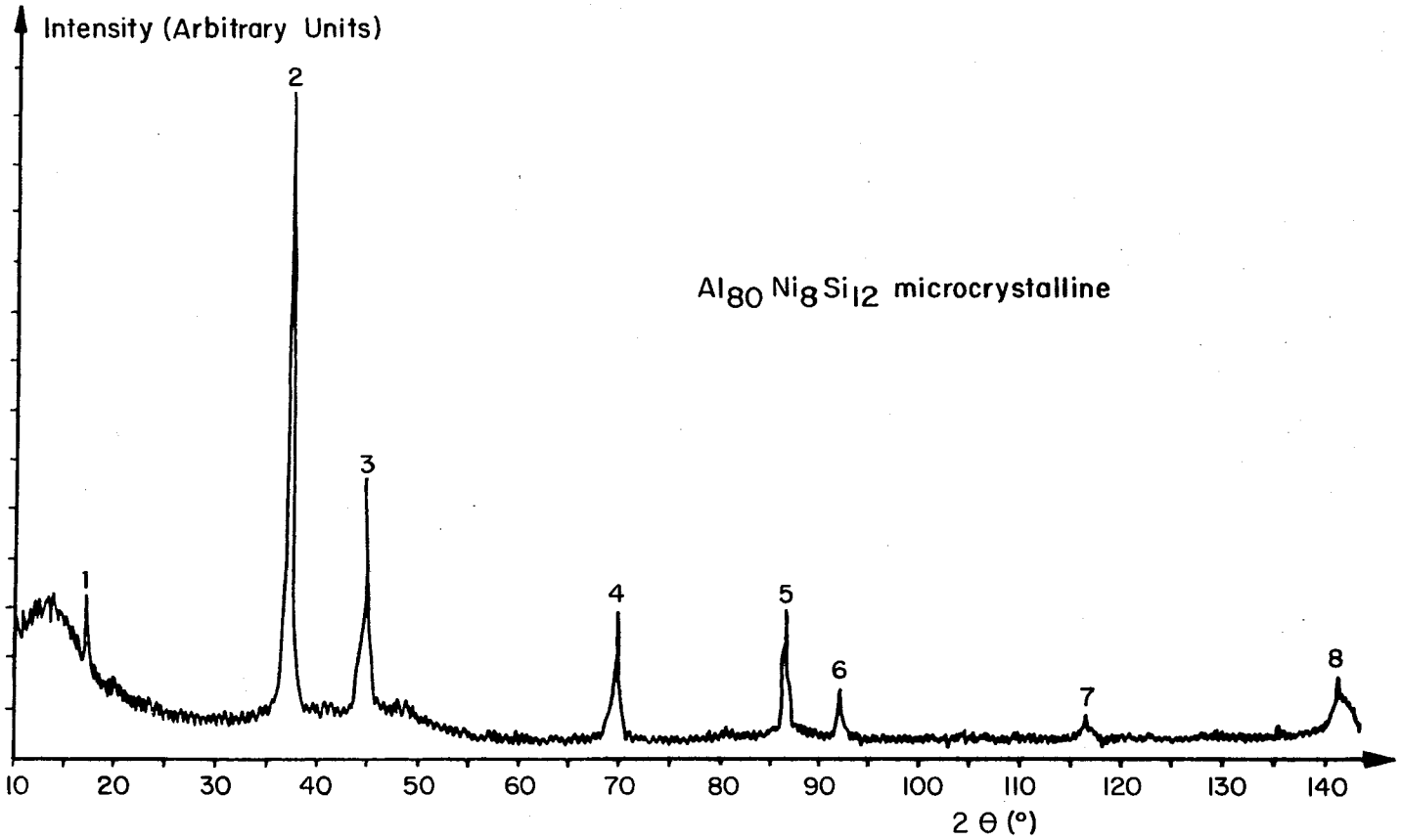
Figure 4:
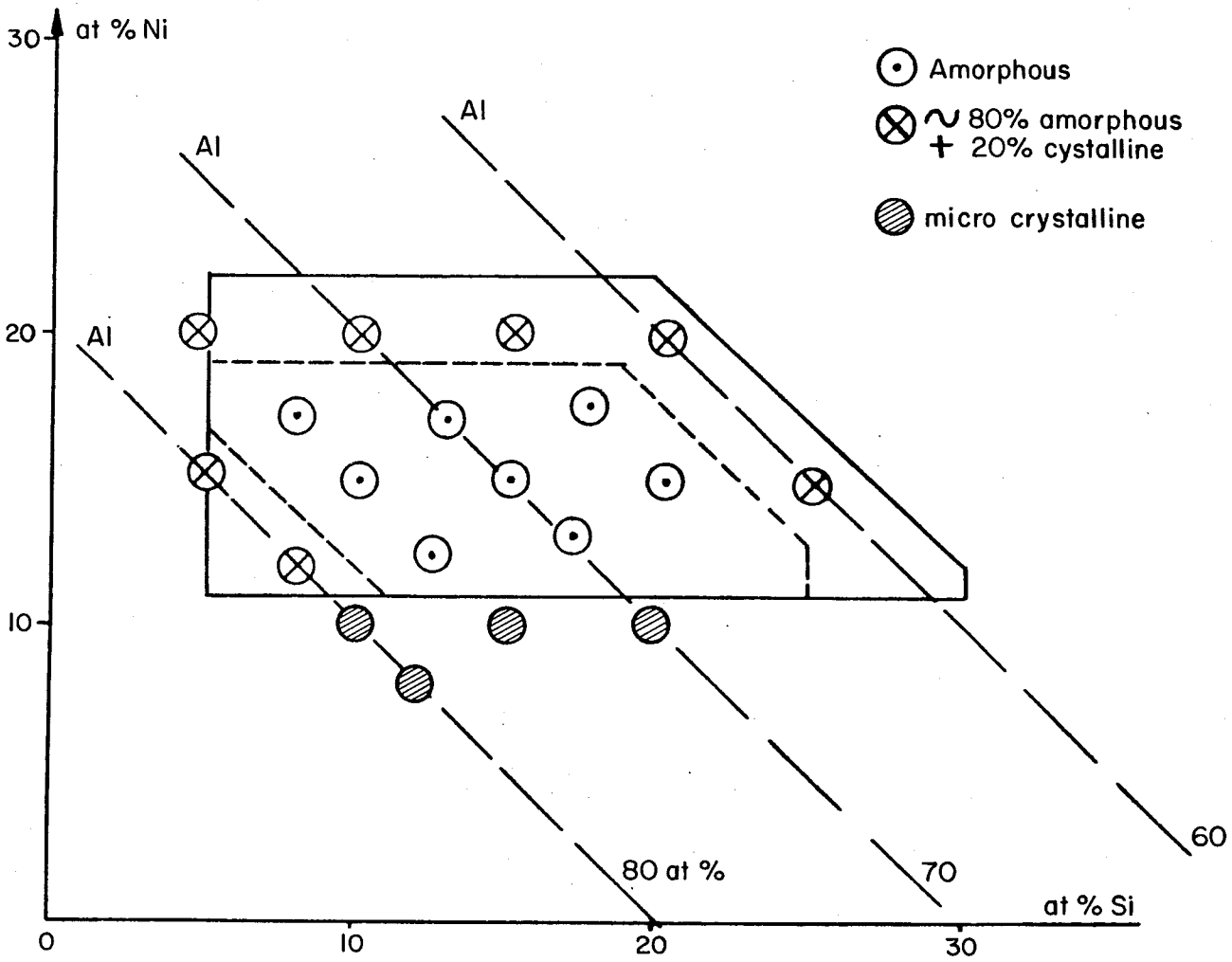
Figure 5:
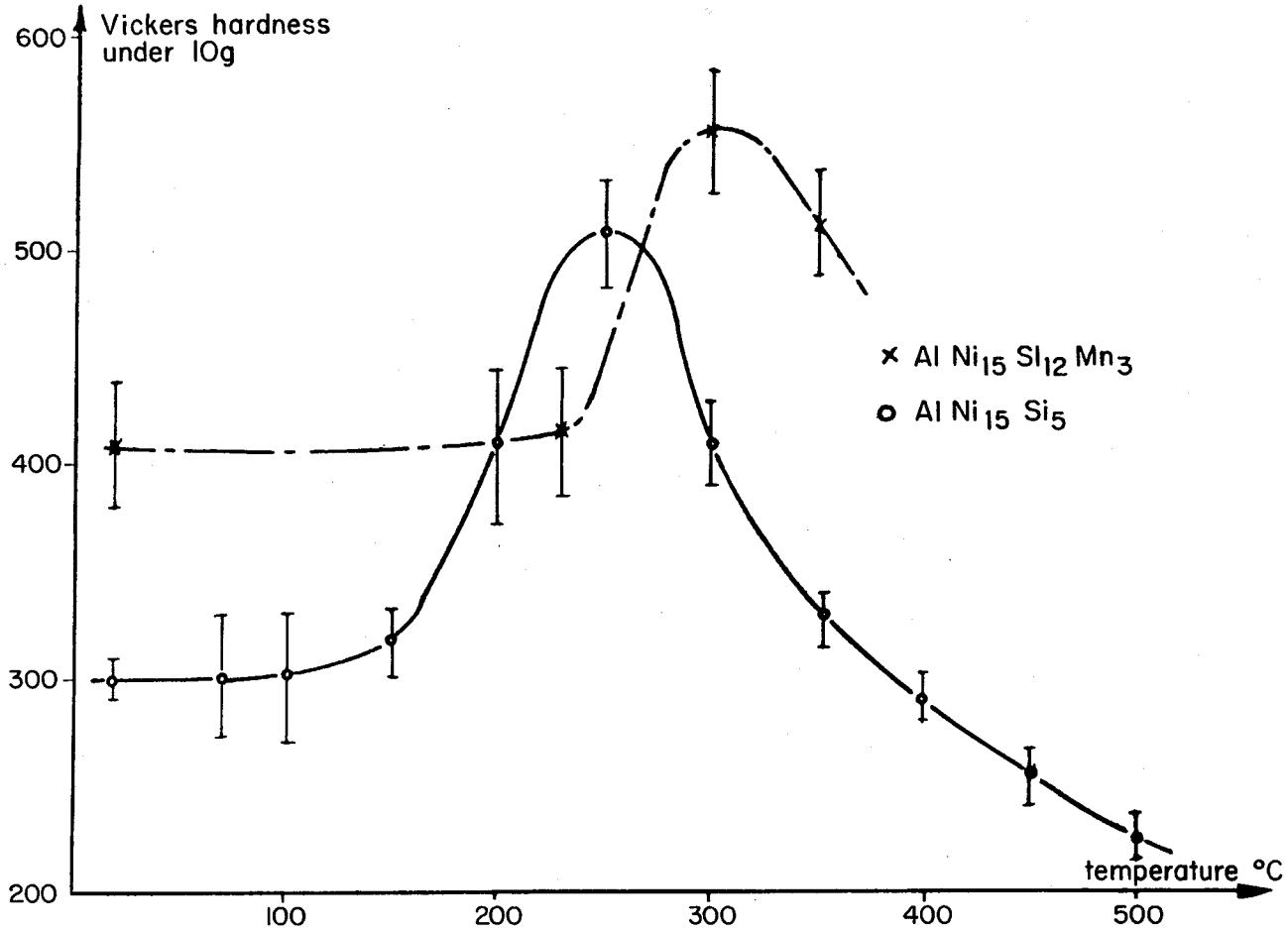
Figure 6:
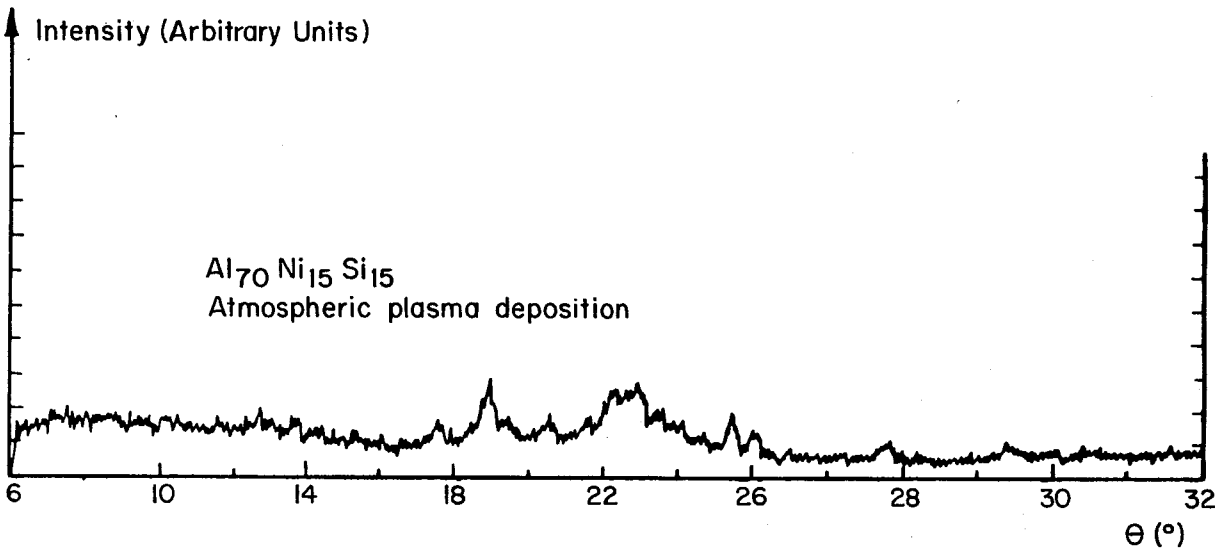
Figure 7:
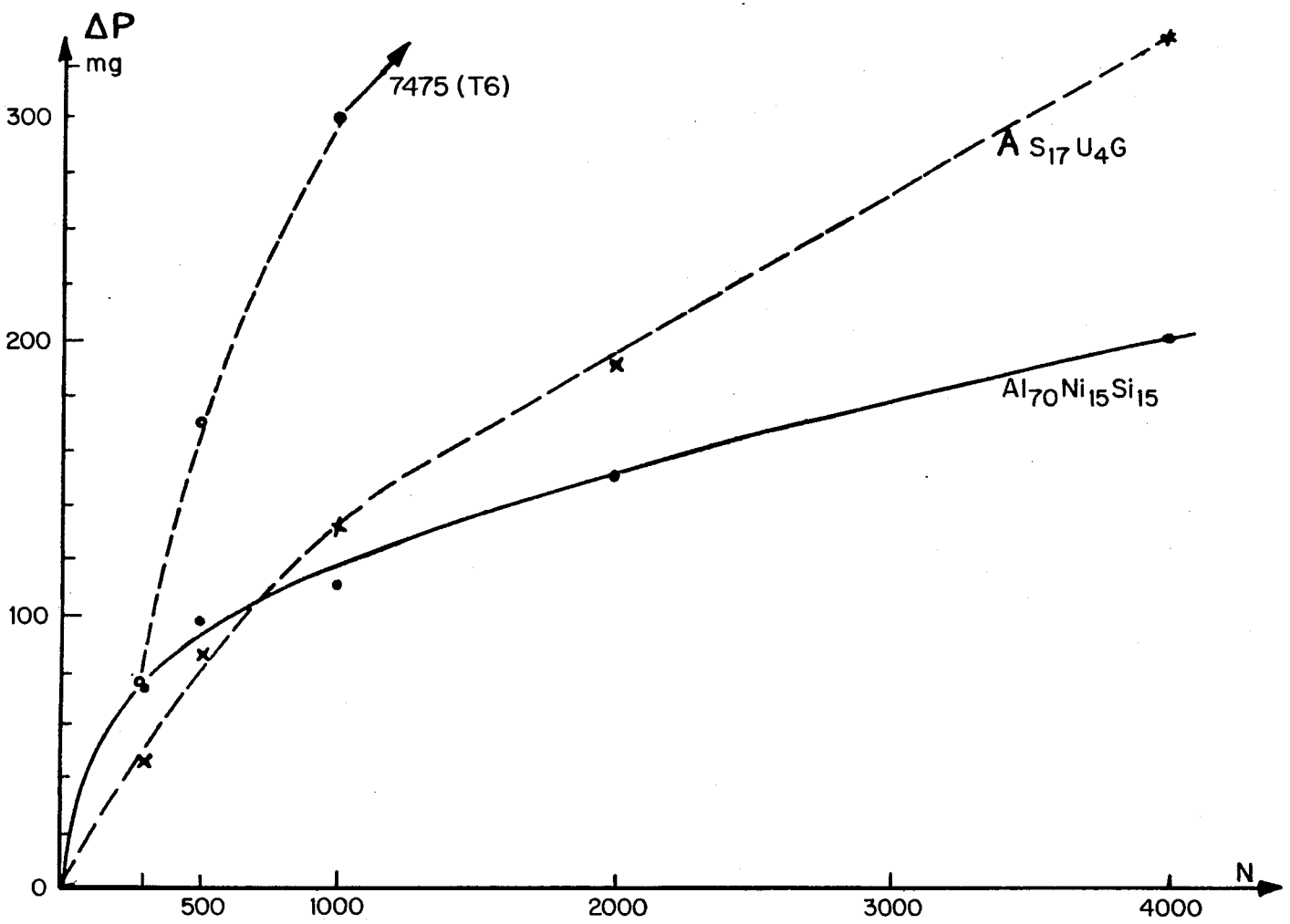

The invention will be better appreciated by reference to the examples described hereinafter and the accompanying drawings in which:

FIGS. 1 to 3 respectively show the diagrams in respect of X-ray diffraction of an amorphous alloy, an essentially amorphous alloy (about 20% in the crystallised state) and a microcrystalline alloy, FIG. 4 shows the limits of composition of the Al-Ni-Si alloys according to the invention, FIG. 5 shows the variation in the Vickers microhardness values of two initially amorphous alloys: $Al_{70}Ni_{15}Si_{12}Mn_{13}$ and $Al_{70}Ni_{15}Si_{15}$ after being maintained for 1 hour at various temperatures, FIG. 6 is a diffractogram of the alloy $Al_{70}Ni_{15}Si_{15}$ deposited by atmospheric plasma and produced with CuKα radiation, and FIG. 7 represents the losses in weight (ΔP) observed on a coating of $Al_{70}Ni_{15}Si_{15}$ in comparison with an alloy A-S17U4G which is recognised as being resistant to wear, in dependence on the number of cycles (N) on a TABER abrasimeter.

EXAMPLE 1

Table 1 sets out examples of compositions of amorphous alloys which are defined within the scope of the present invention and which were produced in the form of strips of 20 μm in thickness by quenching on a Cu wheel, the linear rate of ejection of the strip being 60 $ms^{-1}$. Crystallisation of those alloys was studied by differential enthalpic analysis, by X-ray, by transmission electron microscopy and by measurements in respect of microhardness values. The temperature of the first crystallisation peak is set forth in Table I for each composition. Thus, for the alloy $Al_{70}Ni_{15}Si_{15}$, that temperature is 190° C. whereas it is 295° C. for the alloy $Al_{70}Ni_{15}Si_{12}Mn_3$. For ternary alloys (Al, Ni, Si), that temperature increases:

(a) with a constant Al content, for increasing proportions of Ni, (b) for increasing proportions of alloying elements (Ni+Si)

FIG. 5 shows the variation in the Vickers microhardness under a load of 10 g of strips as measured at 20° C. after isothermal annealing operations for 1 hour at different temperatures. Generally speaking, crystallisation is accompanied by a substantial increase in hardness. The high levels of microhardness attained (300 HV to 560 HV) will be noted. After annealing for 1 hour at 200° C., the alloy $Al_{70}Ni_{13}Si_{17}$ shows abundant crystallisation of a new metastable intermetallic phase of hexagonal structure (a=0.664 nm and c=0.377 nm) with incipient crystallisation of the Al. After 1 hour at 300° C., the alloy is made up of micrograins of Al and Si and orthorhombic equilibrium phase $Al_3Ni$.

Investigations by optical and electronic microscopy in the transmission mode show that after the alloy has been maintained for 1 hour at 400° C., the mean size of the grains is between 0.05 μm and 0.5 μm. That very fine microcrystalline structure can be obtained for such compositions only by annealing of an amorphous alloy, and it imparts both high levels of mechanical strength and high levels of ductility to the alloy.

Table II gives the intereticular distances and the X-ray diffraction angles $\theta$ (radiation K$\alpha$ of Cu) relating to the hexagonal phase encountered after quenching at about 200° C. in an initially amorphous sample of the alloy $Al_{70}Si_{15}Ni_{15}$ (a=0.6611 nm and c=0.3780 nm).

EXAMPLE II

We produced 20 kg of strips of $Al_{70}Ni_{15}Si_{15}$ by quenching on a wheel. The strips were finely crushed and the powder produced in that way was hot compressed. The hot compression billet was extruded at 450° C. with an extrusion ratio of 16:1. The extruded bar was characterised by traction at 20° C., 350° C., 450° C. and 500° C. All the hot traction tests were carried out after the alloy had been maintained at 350° C. for 10 hours. The results obtained are set forth in Table III. Up to 350° C., the material is highly fragile and premature ruptures are found at structural defects. However, the level of breaking stress at 350° C. remains very high. At 450° C. and 500° C. the behaviour of the material is totally different, with elevated degrees of elongation, indicating a highly ductile behaviour.

EXAMPLE III

The alloy $Al_{70}Ni_{15}Si_{15}$ was produced by quenching on a wheel and crushed. The powder obtained was projected by means of an atmospheric plasma on to a substrate of alloy A-S5U3, which gives rise to a rate of solidification of close to $10^4$ K/sec. The deposit produced is 75% amorphous according to semi-quantitative X-ray testing (see FIG. 6). The microhardness of the deposit is 500 Vickers. The behaviour of that deposit, when subjected to abrasion, in comparison with that of an uncoated alloy A-S17U4G, which is known for its resistance to abrasion, was studied on a TABER abrasimeter under the following conditions:

grinding wheel type C5 17 load applied: 1250 g, with measurement of the losses in weight after 300, 500, 1000, 2000 and 4000 cycles.

The results obtained are set forth in Table IV and represented in graph form in FIG. 7.

It is found that the essentially amorphous alloy according to the invention therefore has a very good level of performance in respect of friction effect and abrasion.

TABLE I

| | CRYSTALLINITY | TEMPERATURE OF THE FIRST CRYSTALLISATION PEAK (in °C.) |
|---|---|---|
| TERNARY ALLOYS | | |
| $Al_{75}Ni_{12.5}Si_{12.5}$ | 0 | 159 |
| $Al_{75}Ni_{15}Si_{10}$ | 0 | 199 |
| $Al_{75}Ni_{17}Si_{8}$ | 0 | 219 |
| $Al_{70}Ni_{13}Si_{17}$ | 0 | 157 |
| $Al_{70}Ni_{15}Si_{15}$ | 0 | 190 |
| $Al_{70}Ni_{17}Si_{13}$ | 0 | 226 |
| $Al_{65}Ni_{15}Si_{20}$ | 0 | 217 |
| $Al_{65}Ni_{17.5}Si_{17.5}$ | 0 | 260 |
| $Al_{70}Mn_{13}Si_{17}$ | <25 | — |
| QUATERNARY ALLOYS | | |
| $Al_{70}Ni_{10}Fe_3Si_{17}$ | 0 | 159 |
| $Al_{70}Ni_3Fe_{10}Si_{17}$ | 0 | 248 |
| $Al_{70}Ni_{15}Si_{12}Mn_3$ | 0 | 295 |
| $Al_{70}Ni_{15}Si_{12}B_3$ | 0 | 216 |

TABLE I-continued

| | CRYSTALLINITY | TEMPERATURE OF THE FIRST CRYSTALLISATION PEAK (in °C.) |
|---|---|---|
| $Al_{70}Ni_{15}Si_{12}Fe_3$ | <25 | — |
| $Al_{70}Ni_{15}Si_{12}V_3$ | <25 | — |
| $Al_{80}Ni_{8.5}Si_{8.5}V_3$ | <25 | — |
| $Al_{80}Ni_{8.5}Si_{8.5}Fe_3$ | <25 | — |

TABLE II

| Experimental d(nm) | $\sigma^0$ | Theoretical d(nm) | $\sigma^0$ | h-k-l |
|---|---|---|---|---|
| 0.57488 | 7.70 | 0.57253 | 7.73 | 100 |
| 0.57055 | 13.48 | 0.57055 | 13.48 | 110 |
| 0.57595 | 14.11 | 0.57575 | 14.13 | 101 |
| 0.57859 | 18.05 | 0.57883 | 18.03 | 111 |
| 0.57807 | 19.74 | 0.57821 | 19.73 | 201 |
| 0.57592 | 20.90 | 0.57540 | 20.85 | 210 |
| 0.57040 | 23.86 | 0.57084 | 23.80 | 300 |
| 0.57745 | 24.26 | 0.57780 | 24.21 | 211 |
| 0.57488 | 27.85 | 0.57407 | 18.00 | 112 |
| 0.57838 | 29.10 | 0.57879 | 29.02 | 310 |
| 0.57098 | 30.68 | 0.57143 | 30.57 | 221 |
| 0.57597 | 31.85 | 0.57640 | 31.74 | 311 |
| 0.57219 | 32.80 | 0.57235 | 32.76 | 212 |
| 0.57404 | 35.07 | 0.57429 | 35.00 | 302 |
| 0.57455 | 38.20 | 0.57441 | 38.25 | 222 |

TABLE III

ALLOY $Al_{70}Ni_{15}Si_{15}$ EXTRUDED A 450° C.
TRACTION TEST
(lengthwise direction)

| T test (°C.) | $R_p0.2$ (MPa) | Rm (MPa) | A (%) |
|---|---|---|---|
| 20 | — | 227 | ~0 |
| | — | 320 | ~0 |
| | — | 240 | ~0 |
| 350* | — | 286 | ~0 |
| | — | 246 | ~0 |
| 450* | 23 | 30 | 35 |
| 500* | 10 | 13 | 40 |

*Testpieces annealed for 10 hours at 350° C. and then brought to the test temperature in about 1 hour.

TABLE IV

| Alloy | No of cycles (N) | Weight loss (P) (in g) |
|---|---|---|
| $Al_{70}Si_{15}Ni_{15}$ (according to the invention) | 300 | $4.6 \cdot 10^{-3}$ |
| | 500 | $8.7 \cdot 10^{-3}$ |
| | 1000 | $1.3 \cdot 10^{-2}$ |
| | 2000 | $1.9 \cdot 10^{-2}$ |
| | 4000 | $3.1 \cdot 10^{-2}$ |
| A-S17U4G uncoated (reference) | 300 | $7.4 \cdot 10^{-3}$ |
| | 500 | $9.7 \cdot 10^{-3}$ |
| | 1000 | $1.1 \cdot 10^{-2}$ |
| | 2000 | $1.5 \cdot 10^{-2}$ |
| | 4000 | $2 \cdot 10^{-2}$ |

I claim:

1. Microcrystalline Al-based alloy produced by annealing an alloy formed initially in a substantially amorphous state by rapid solidification, between $10^5$ and $10^4$ °K./sec., from a temperature range at around 100° C. above the liquidus of the alloy produced, consisting essentially of, in atomic %:

from 5 to 30% Si from 11 to 22% Ni wherein the Ni may be partially substituted by Fe up to 10%, by V or B up to 5% each, or totally substituted by Mn up to 22%, and wherein Fe+Ni+Si≦42% the balance being formed by Al and the usual production impurities, said alloy containing, in the microcrystalline state, in the vicinity of the first crystallization peak, a metastable hexagonal phase whose crystalline parameters are about a=0.661 nm and c=0.378 nm.

2. Alloy according to claim 1, consisting essentially of, in atomic %:

from 5 to 25% Si from 11 to 19% Ni wherein 21%<Ni+Fe+Si<38%, and wherein manganese is no more than about 5 atomic %.

3. Alloy according to claim 1, wherein the grain size is between 0.05 and 0.5 μm.

4. Process for producing alloy as defined in claim 1, comprising the steps of:

applying a nickel coating to a portion of Al Si substrate;

subjecting the applied coating and the adjacent substrate to a local fusion operation by means of a concentrated heat source;

rapidly solidifying the portion which is coated and fused by natural cooling to a substantially amorphous state; and annealing the substantially amorphous alloy to said microcrystalline state.

5. Process according to claim 4, wherein said substrate contains between 10 and 25 atomic % Si.

6. A process for producing alloy according to claim 1, comprising projecting under plasma pre-alloyed powder on to a metallic substrate, or a good conductor of heat, rapidly solidifying the alloy produced thereby to a substantially amorphous state, and annealing said substantially amorphous alloy to said microcrystalline state.

7. A product produced from an alloy according to claim 1 by the steps of crushing said alloy to a grain size of less than 100 μm, then hot compressing at between 350° and 400° C., and finally hot extruding at about 400° to 450° C.

8. A product produced from an alloy produced by the process according to claim 4, 5 or 6, wherein resistance to friction and abrasion is improved.

9. A product produced from an alloy produced by the process according to claim 4, 5 or 6, which is resistant to heat, up to about 400° C.

10. The product of claim 7, having improved resistance to friction and abrasion.

11. The product of claim 7, having resistance to heat, up to about 400° C.

* * * * *